United States Patent [19]

Ainsworth et al.

[11] Patent Number: 4,924,037

[45] Date of Patent: May 8, 1990

[54] ELECTRICAL CABLE

[75] Inventors: James Ainsworth, Phoenix, Ariz.; William G. Hardie, Newark, Del.; Edward L. Kozlowski, Jr., Elkton, Md.; Dinesh T. Shaf, Chandler, Ariz.

[73] Assignee: W. L. Gore & Associates, Inc., Newark, Del.

[21] Appl. No.: 286,919

[22] Filed: Dec. 20, 1988

[51] Int. Cl.[5] ..... H01B 7/08

[52] U.S. Cl. ..... 174/117 F; 156/55; 156/56; 174/110 R; 174/110 SR

[58] Field of Search ..... 174/117 F, 117 FF, 110 FC, 174/110 R, 110 SR, 120 R, 120 SR; 156/51, 55, 56

[56] References Cited

U.S. PATENT DOCUMENTS

| | | | |
|---|---|---|---|
| 3,792,409 | 2/1974 | Smart et al. | 338/214 |
| 3,857,996 | 12/1974 | Hansen et al. | 174/120 SR X |
| 3,914,363 | 10/1975 | Bedard et al. | 264/105 |
| 3,980,807 | 9/1976 | Woytiuk | 174/107 |
| 4,010,619 | 3/1977 | Hightower et al. | 174/110 FC X |
| 4,250,351 | 2/1981 | Bridges | 174/106 R |
| 4,281,210 | 7/1981 | Brauer et al. | 174/110 SR X |
| 4,306,923 | 12/1981 | MacPherson | 174/70 R X |
| 4,423,282 | 12/1983 | Suzuki et al. | 174/117 F X |
| 4,529,564 | 7/1985 | Harlow | 174/110 FC X |
| 4,639,693 | 1/1987 | Suzuki et al. | 174/117 F X |
| 4,741,594 | 5/1988 | Suzuki | 350/96.23 |

FOREIGN PATENT DOCUMENTS

| | | | |
|---|---|---|---|
| 2614807 | 10/1977 | Fed. Rep. of Germany | 174/120 R |

*Primary Examiner*—Morris H. Nimmo

*Attorney, Agent, or Firm*—Gary A. Samuels

[57] ABSTRACT

An electrical cable of conductive wire having an insulating layer of microporous polymeric material around it, followed by a coating of a polyesterpolyurethane surrounding the insulating layer, and an outer film of polyetherpolyurethane surrounding the coating.

5 Claims, 1 Drawing Sheet

ELECTRICAL CABLE

FIELD OF THE INVENTION

This invention relates to electrical cable and to a method for preparing it.

BACKGROUND OF THE INVENTION

Heretofore, conductive electrical wire, such as copper wire, has been coated with film of microporous, expanded polytetrafluoroethylene (PTFE) to provide an insulated wire. The PTFE coating provided a low dielectric, flexible, chemically resistant protective covering surrounding the conductive wire. This assembly is then ordinarily provided with an outer insulative covering of full density, non-expanded polytetrafluoroethylene to provide a covering that is heat resistant, is chemically inert, is resistant to being cut (called cut-through resistance) and is of long flex life. This configuration is particularly useful for flat or ribbon cable, such as is described in U.S. Pat. No. 4,443,657.

It is desirable to provide a cable that has the attributes of the above-described cable, has good flex life, and has substantially improved abrasion resistance and further improved cut-thru resistance.

The invention herein possesses these desirable features.

SUMMARY OF THE INVENTION

An electrical cable comprising:

(a) at least one conductive wire, (b) an insulating layer surrounding the conductive wire, said insulating layer comprising microporous polymeric material, such as expanded sintered polytetrafluoroethylene, (c) a coating of an organic solvent soluble polyurethane surrounding the insulating layer, (d) a film covering and surrounding the coating comprising a film of an extruded polyurethane.

DETAILED DESCRIPTION OF THE INVENTION

The cable of the present invention is particularly adaptable for use where ribbon or flat cable containing a plurality of parallel wire conductors in coplanar configuration are desired. One advantage of the cable of this invention is the excellent abrasion resistance that is achieved, while further improving the good cut-through resistance of previous cable constructions.

Figure 1:
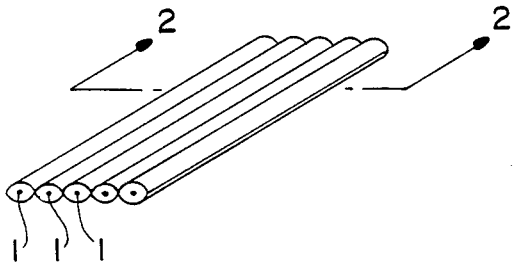
FIG. 1 represents a three dimensional perspective view of one embodiment of the cable of this invention.
Figure 2:
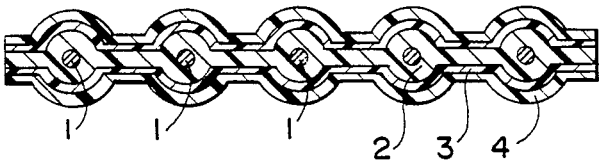
FIG. 2 represents a cutaway enlarged view of the cable of FIG. 1 taken along line 2—2 of FIG. 1.

With reference to FIGS. 1 and 2, there is provided a plurality of center wire conductors 1, surrounded by insulation of low dielectric 2 which is a microporous polymer such as polytetrafluoroethylene made generally as described in U.S. Pat. No. 3,953,566. Other microporous polymers useful herein include microporous polyolefins and other such polymers that are receptive to polyurethane primers.

Surrounding the insulation 2 is a layer of a polyurethane, 3 that is soluble in an organic solvent, such as polyesterpolyurethane, for example, Estane number 5703 provided by B. F. Goodrich Co. This layer is ordinarily applied by solution coating, as for example, dip-coating the insulated wire in a solution of the polyesterpolyurethane. A typical solution of such polyurethane is a 5–20% by weight solution in a suitable organic solvent, such as a halogenated solvent, as for example, methylene chloride. Other suitable solvents include methyl ethyl ketone, toluene, N-methyl pyrollidone, dimethyl formamide, glycidyl methacrylate, tetrahydrofurane, and the like. Temperature and pressure are not critical.

The coating 3 is applied as a primer solution to enable the jacket coating 4 to be applied with ease and good adherability. The coating 3 works its way partially into the pores of the microporous, expanded polytetrafluoroethylene and provides a firm interlocking bond therewith, thus, providing a firm foundation for the jacket coating 4.

The jacket coating 4 is a layer of an extrudable polyurethane, such as a polyetherpolyurethane, as for example, Estane number 58202 supplied by B. F. Goodrich Co. which contains antimony trioxide flame retardant. The coating 4 is applied as a melt extruded film and is laminated to polyurethane coating 3 with the aid of compression rolls. Preferably, a common flame-retardant is added to the jacket film, but such is not absolutely necessary.

The fabrication of the conductor wire entails the initial steps of embedding the conductor 1 in top and bottom inner films of microporous polymer, such as expanded unsintered PTFE and compressing the films together around the conductor to form insulation 2. Compression is ordinarily carried out at room temperature in a roll nip under pressure.

The resulting insulated wire is then subjected to a coating solution of the organic solvent solution of polyurethane by any usual means. One such means is by immersing the insulated wire into the solution and passing the wire continuously through the solution. Room temperature and pressures are conveniently used. The resulting insulated wire now is coated with primer coating 3.

A film of extrudable polyurethane is next laminated to the assembly. Conveniently a film of extruded polyurethane is applied to each side of the coated wire, which is preferably in ribbon or flat form, simultaneously and fused to each other at the edges to entirely encapsulate the coated, insulated wire assembly. Conveniently, the polyurethane films are thermally extruded into film form and brought into contact with the assembly in film form. Thus, the polyurethane film is applied hot, i.e., at nearly the extrusion temperature, which is about 180° C. The two films are contacted with the wire construction by passing through the nip of two compression rollers. The resulting assembly is then cooled. Thus, the polyurethane jacket film finally bonds to itself at the edges of the final construction of this invention, and finally bonds to the polyurethane primer coating already on the assembly.

EXAMPLE 1

Twenty six conductors, each of 28 gauge 19 strand bare copper wire #135, spaced on 0.050 inch centers in a planar configuration, obtained from Hudson International Conductors, Inc., were continuously coated with two layers of expanded microporous, 10 mil thick PTFE tape obtained from W. L. Gore & Associates, Newark. Del., by passing the wires and the tape on each side thereof through the nip of two compression rolls at 80 lbs. pressure at a pull weight of 20 lbs., and then the PTFE layers were sintered by feeding into a bath of molten salt at a line speed of 15 feet per minute and then cooled by subjecting to water at 15° C. This procedure embeds the conductors between the two layers of PTFE tape. The two PTFE layers are bonded by the sintering procedure. The laminated wire was then dipped in a solution of Estane 5703, a polyesterpolyurethane composition, and a solvent, methylene chloride. The solution was 8% by weight of polyesterpolyurethane. The line speed was 5 feet per minute. This step was carried out at room temperature and pressure. The wire was then dried in steps at 65° C., then 90° C., and then 120° C. to insure uniform complete drying.

The coated laminate was then covered by two layers of polyetherpolyurethane film in a 1½" Entwistle extruder with a 24 L/D ratio screw. The line speed was 3–5 RPM and the extrusion zone temperatures were 135° C. 165° C. 170° C., and 180° C. with a die temperature of 160° C. In operation, the polyetherpolyurethane was melt extruded into two continuous films that were immediately applied to each side of the coated laminate. The combination was then passed through compression rollers to bond the polyetherpolyurethane layers together.

The abrasion resistance of the cable assembly was determined by MIL-T-5438. The cable was too wide to fit the testing machine and was slit to provide 8 conductors.

The side having 11.62–12.9 mils of insulation required 534 and 476 inches of abrasive tape to wear through, respectively. The side having 12.25–12.52 mils insulation required 512 inches of abrasive tape to wear through.

A conventional construction of a 16 strand ribbon cable wire having the microporous expanded PTFE insulation with a protective covering of unexpanded PTFE, in which the total thickness was about 12 mil, used only 222 inches and 218 inches, in two tests, of abrasive tape before the insulation was worn through (when the protective covering contained blue pigment) and only 153 inches and 166 inches (two tests) to wear through (when the protective covering contained grey pigment).

Wire coated in a similar manner as that set forth in Example I exhibited good flex life.

We claim:

1. An electrical cable comprising:

(a) at least one conductive wire (b) an insulating layer surrounding the conductive wire, said insulating layer comprising a microporous polymeric material, (c) a coating of an organic solvent soluble polyurethane surrounding the insulating layer, (d) a film covering and surrounding the coating comprising a film of extruded polyurethane.

2. The cable of claim 1 wherein the polyurethane coating is formed from a solution of a polyesterpolyurethane in an organic solvent.

3. The cable of claim 1 wherein the extruded polyurethane film is a polyetherpolyurethane.

4. An electrical cable comprising a series of side-by-side parallel conductive wires arranged in a coplaner configuration to form a flat construction; said wires covered and surrounded by an insulative layer of expanded, microporous polytetrafluoroethylene, said insulative layer containing an outer covering of a polyesterpolyurethane; said cable having a layer of polyetherpolyurethylene laminated to each side of said flat construction, so as to form a solid protective film coating surrounding the assembly within.

5. A process for making the cable of claim 1 which comprises:

(a) applying microporous polymeric material around a conductive wire to form an insulative coating, (b) subjecting the coated wire to a solution of an organic solvent soluble polyurethane and drying the resulting assembly, (c) laminating film of an extruded polyurethane around said resulting assembly in a manner that encapsulates said assembly.

* * * * *